US010464078B2

(12) United States Patent
Cheng

(10) Patent No.: US 10,464,078 B2
(45) Date of Patent: Nov. 5, 2019

(54) SPRINKLER STRUCTURE

(71) Applicant: Yuan Mei Corp., Chang Hua Hsien (TW)

(72) Inventor: Chi-Han Cheng, Chang Hua Hsien (TW)

(73) Assignee: Yuan Mei Corp., Chang Hua Hsien (TW)

( * ) Notice: Subject to any disclaimer, the term of this patent is extended or adjusted under 35 U.S.C. 154(b) by 136 days.

(21) Appl. No.: 15/892,203

(22) Filed: Feb. 8, 2018

(65) Prior Publication Data

US 2019/0240681 A1 Aug. 8, 2019

(51) Int. Cl.

| | |
|---|---|
| ***B05B 1/16*** | (2006.01) |
| ***B05B 1/20*** | (2006.01) |
| ***B05B 3/02*** | (2006.01) |

(52) U.S. Cl.

CPC ..... *B05B 1/1663* (2013.01); *B05B 1/20* (2013.01); *B05B 3/02* (2013.01)

(58) Field of Classification Search

CPC ..... B05B 1/1663; B05B 1/72; B05B 1/169; B05B 1/20; B05B 1/205; B05B 3/02; B05B 3/04; B05B 3/0409; B05B 3/0418; B05B 3/0422; B05B 3/0431; B05B 3/044; B05B 3/14; B05B 3/16

USPC ..... 239/237, 240, 242, 246–248, 560, 561, 239/562, 566

See application file for complete search history.

(56) References Cited

U.S. PATENT DOCUMENTS

| | | | | |
|---|---|---|---|---|
| 6,736,340 | B1 * | 5/2004 | Wang | A62C 2/08 239/242 |
| 7,258,286 | B1 | 8/2007 | Wang et al. | |
| 7,284,714 | B1 | 10/2007 | Wang et al. | |
| 7,909,266 | B2 * | 3/2011 | Lo | B05B 15/652 239/242 |
| 8,534,573 | B2 * | 9/2013 | Wang | B05B 15/652 239/242 |

(Continued)

FOREIGN PATENT DOCUMENTS

| | | | |
|---|---|---|---|
| CA | 2551410 | A1 | 9/2007 |
| CA | 2551413 | A1 | 9/2007 |
| CN | 101085431 | A | 12/2007 |

(Continued)

*Primary Examiner* — Christopher S Kim
(74) *Attorney, Agent, or Firm* — Stinson LLP

(57) ABSTRACT

A sprinkler structure contains: an accommodation tube, multiple water outflow zones, multiple grooved partitions, multiple first water gathering zones, and multiple second water gathering zones. Each first water gathering zone has a first inlet, and each second water gathering zone has a second inlet, the accommodation tube includes multiple first guide orifices and multiple second guide orifices. Each first guide orifice communicates with the accommodation tube, and each second guide orifice communicates with the accommodation tube, hence a control bar is rotatably connected and horizontally moves in each first guide orifice and each second guide orifice. The control bar further includes an inflow chamber and a receiving portion for housing a stop element, such that the stop element abuts against each first water gathering zone and each second water gathering zone. The control bar further includes two seal rings, and the accommodation tube further includes an elongated lid.

18 Claims, 9 Drawing Sheets

(56) References Cited

U.S. PATENT DOCUMENTS

2019/0240681 A1* 8/2019 Cheng ..... B05B 1/1663

FOREIGN PATENT DOCUMENTS

| | | | |
|---|---|---|---|
| CN | 101085432 | A | 12/2007 |
| DE | 102006043879 | A1 | 9/2007 |
| DE | 102006043883 | A1 | 9/2007 |
| EP | 2440336 | A1 | 4/2012 |
| FR | 2898769 | A1 | 9/2007 |
| FR | 2898770 | A1 | 9/2007 |
| GB | 2436305 | A | 9/2007 |
| GB | 2436306 | A | 9/2007 |
| TW | 200735765 | A | 10/2007 |
| TW | 200735766 | A | 10/2007 |
| WO | WO2010133236 | A1 | 11/2010 |

* cited by examiner

SPRINKLER STRUCTURE

TECHNICAL FIELD

The present disclosure relates to a sprinkler structure which contains a control bar configured to control water to flow into or not flow into the first gathering zone or the second gathering zone.

BACKGROUND

A conventional garden sprinkle is disclosed in U.S. Pat. Nos. 7,258,286 and 7,284,714, wherein each control element mates with a tube so that water flows out of a sole nozzle, thus limiting water spray. A sprinkler device is disclosed in 2010133236 A1, wherein water flows out of a control bar on a peripheral side of the sprinkler device via a bend section of the sprinkler device, thus reducing flowing speed. To control water flow and leakproof function, at least four seal rings are arranged on the control bar, thus increasing moving resistance of the control bar.

SUMMARY

A primary aspect of the present invention is to provide a sprinkler structure which contains a control bar configured to control water to flow into or not flow into the first gathering zone or the second gathering zone, thus controlling a number of the multiple nozzle elements where water sprays out.

Another aspect of the present invention is to provide a sprinkler structure which avoids water leakage out of the accommodation tube.

To obtain the above aspects, a sprinkler structure provided by a first embodiment of the present invention contains: an accommodation tube, multiple water outflow zones separately defined on a middle section of a top of the accommodation tube, multiple grooved partitions arranged on two ends of the top of the accommodation tube respectively, multiple first water gathering zones and multiple second water gathering zones which are defined inside the multiple grooved partitions individually. Each of the multiple first water gathering zones has a first inlet defined on a bottom thereof and communicating with the accommodation tube, and each of the multiple second water gathering zones has a second inlet defined on a bottom thereof and communicating with the accommodation tube, the accommodation tube includes multiple first guide orifices arranged on a first peripheral side thereof, and the accommodation tube includes multiple second guide orifices arranged on a second peripheral side thereof, wherein each of the multiple first guide orifices is located below two sides of each first water gathering zone and communicates with the accommodation tube, and each of the multiple second guide orifices is located below two sides of each second water gathering zone and communicates with the accommodation tube, hence a control bar is rotatably connected and horizontally moves in each first guide orifice and each second guide orifice. The control bar includes an inflow chamber defined on a top thereof and includes a receiving portion formed on a side of the inflow chamber so as to house a stop element, such that the stop element abuts against a bottom of each first water gathering zone and of each second water gathering zone. The control bar further includes two seal rings accommodated thereon and individually abutting against each first guide orifice and each second guide orifice, and the accommodation tube further includes an elongated lid connected on the top of the accommodation tube so as to cover and separate the multiple water outflow zones, the multiple first water gathering zones, and the multiple second water gathering zones. The elongated lid includes multiple nozzle elements formed on a top thereof, each first water gathering zone communicates with one or more than one first water gathering zone, and each second water gathering zone communicates with one or more than one first water gathering zone.

A sprinkler structure provided by a second embodiment of the present invention contains: an accommodation tube including multiple water gathering zones so as to match with a control bar, each of the multiple water gathering zones having an inlet defined on a bottom of each water gathering zone and communicates with the control bar. The accommodation tube includes multiple first guide orifices arranged on a first peripheral side thereof, and the accommodation tube includes multiple second guide orifices arranged on a second peripheral side thereof, wherein each of the multiple first guide orifices is located below two sides of each water gathering zone adjacent to the first peripheral side of the accommodation tube and communicates with the accommodation tube, and each of the multiple second guide orifices is located below two sides of each water gathering zone adjacent to the second peripheral side of the accommodation tube and communicates with the accommodation tube, hence a control bar is rotatably connected and horizontally moves in each first guide orifice and each second guide orifice. The control bar includes an inflow chamber defined on a top thereof and includes a receiving portion formed on a side of the inflow chamber so as to house a stop element, such that the stop element abuts against a bottom of each water gathering zone. The control bar further includes two seal rings accommodated thereon and individually abutting against each first guide orifice and each second guide orifice, the accommodation tube further includes an elongated lid connected on the top of the accommodation tube so as to cover and separate the multiple water gathering zones, wherein each water gathering zone communicates with two or more than two nozzle elements, hence the inflow chamber and the stop element are pushed by the control bar to control water to flow or not flow into the water gathering zone, thus controlling a number of the multiple nozzle elements where water sprays out.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
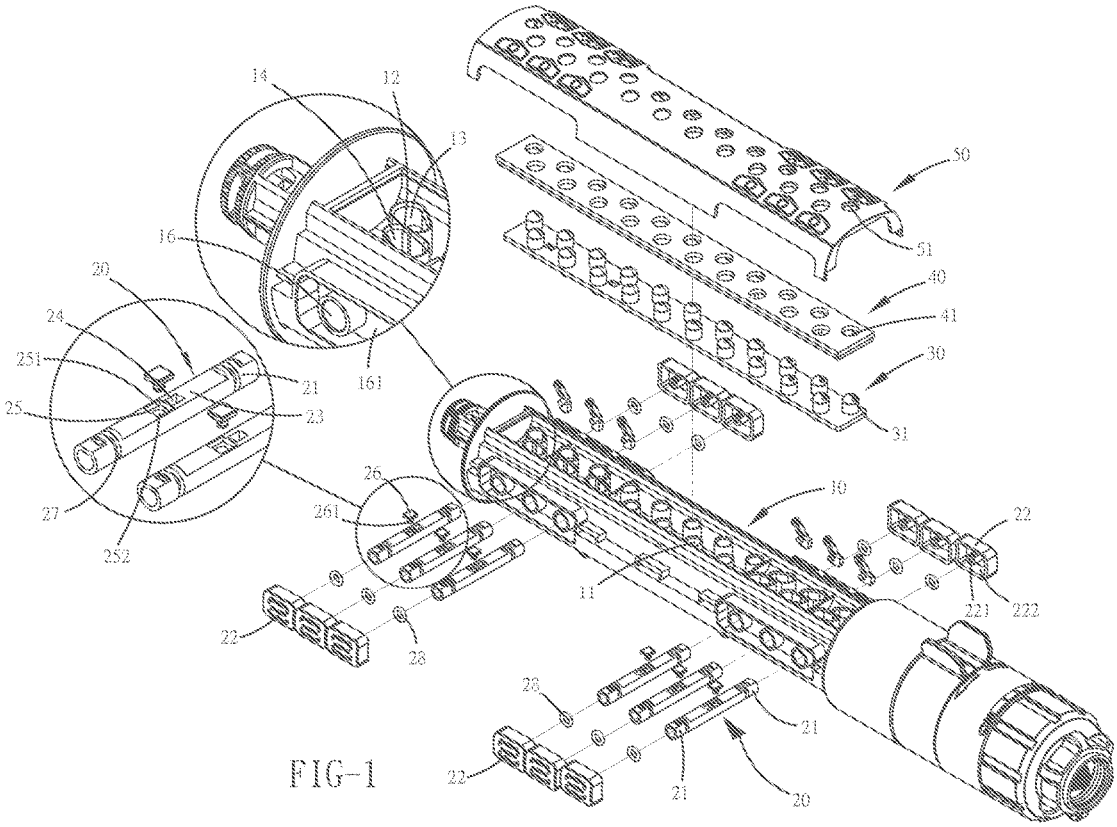
FIG. 1 is a perspective view showing exploded components of a sprinkler structure according to a first embodiment of the present invention.
Figure 2:
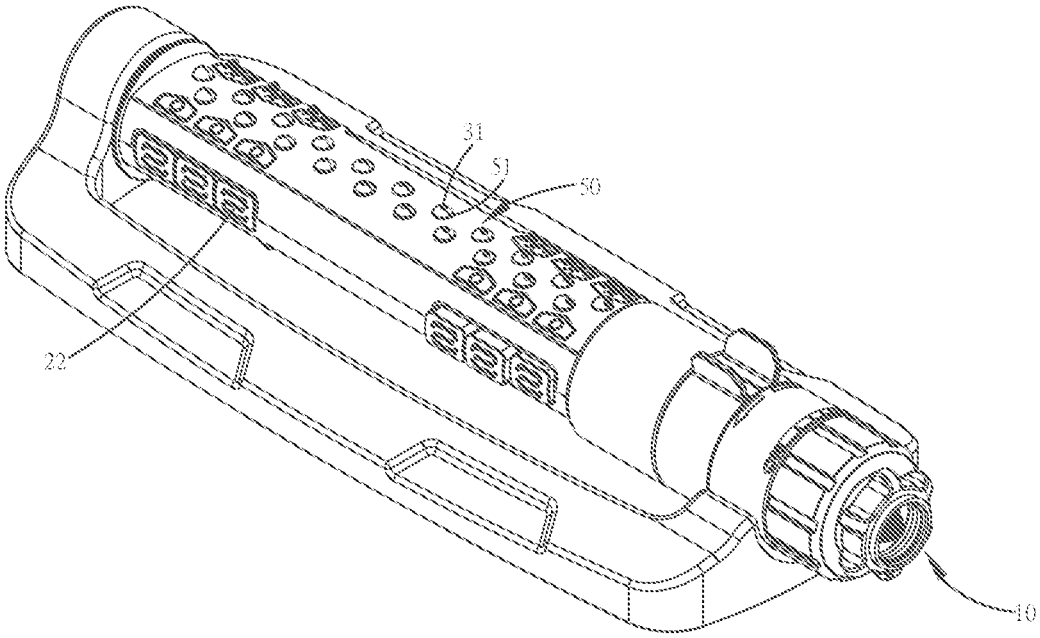
FIG. 2 is a perspective view showing the assembly of the sprinkler structure according to the first embodiment of the present invention.
Figure 3:
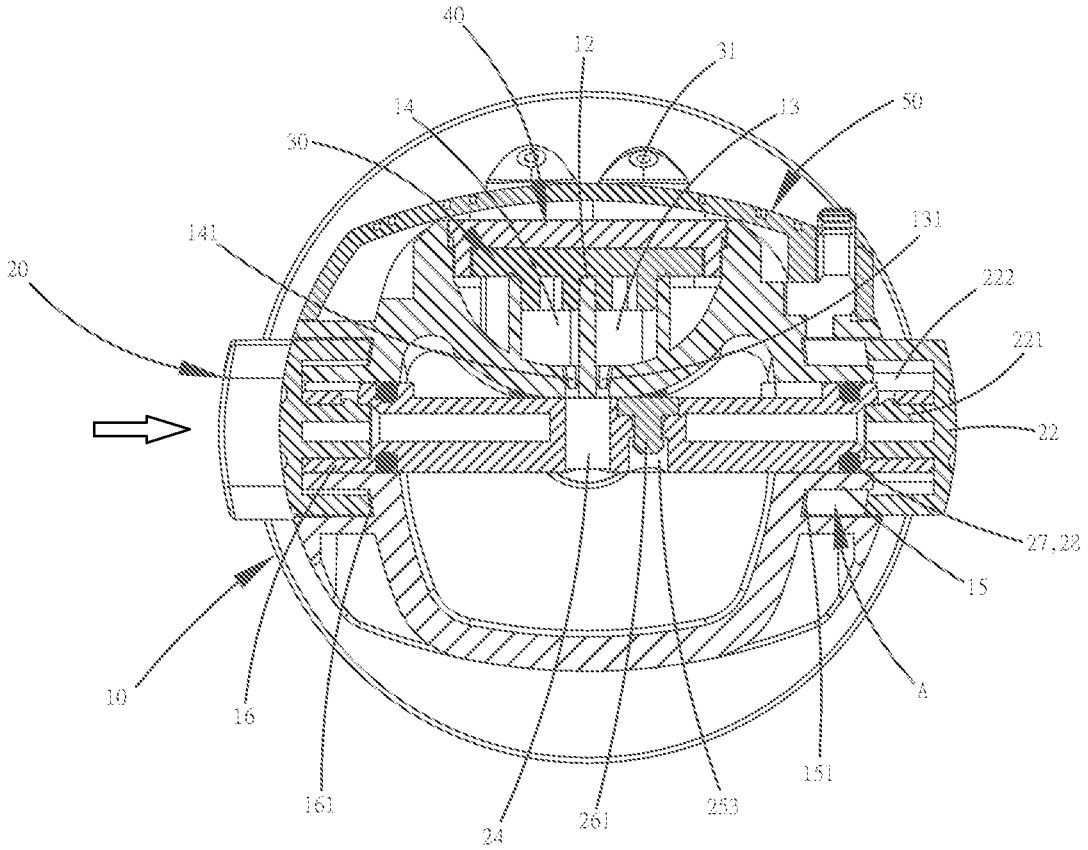
FIG. 3 is a cross sectional view showing the assembly of the sprinkler structure according to the first embodiment of the present invention.
Figure 4:
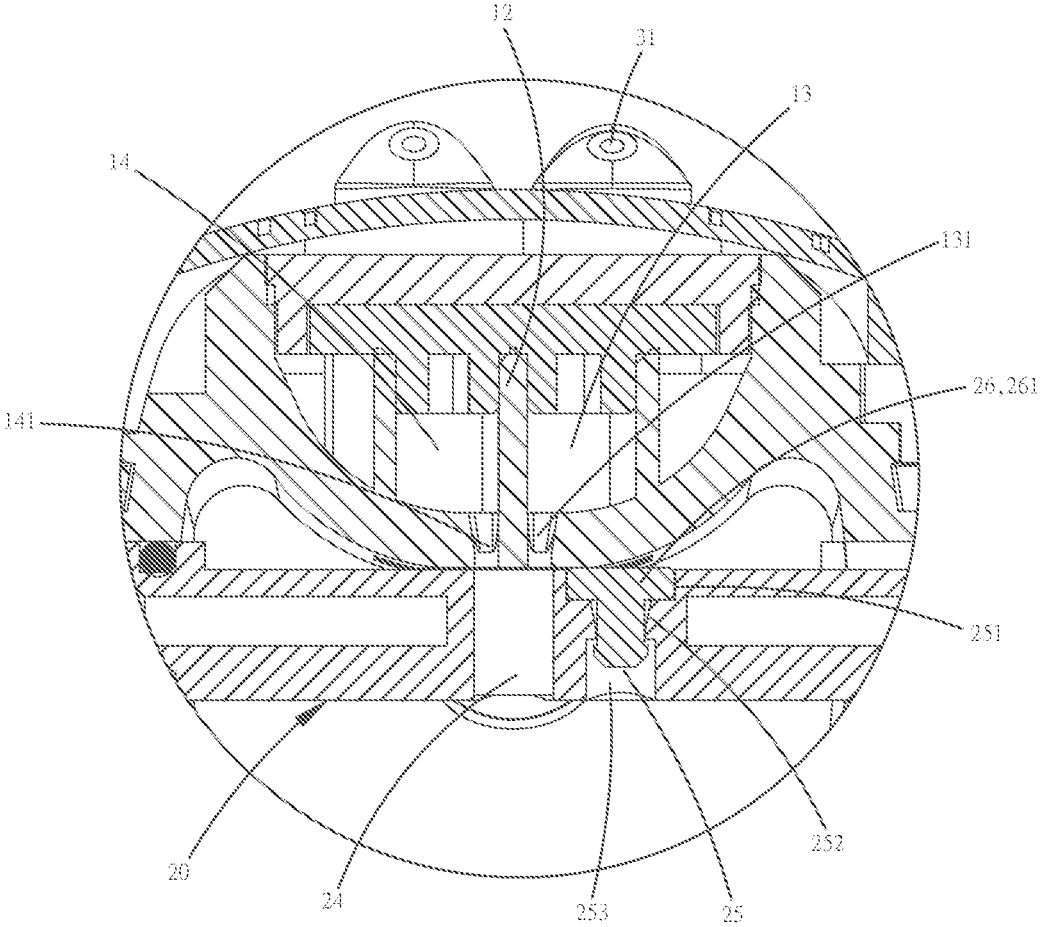
FIG. 4 is an amplified view of a portion of FIG. 3.

With reference to FIGS. 1 to 3, a sprinkler structure according to a first embodiment of the present invention comprises: an accommodation tube 10, multiple water outflow zones 11 separately defined on a middle section of a top of the accommodation tube 10, multiple grooved partitions 12 arranged on two ends of the top of the accommodation tube 10 respectively, multiple first water gathering zones 13 and multiple second water gathering zones 14 which are defined inside the multiple grooved partitions 12 individually, wherein a bottom of each of the multiple first water gathering zones 13 is flat and has a first inlet 131 defined thereon and communicating with the accommodation tube 10, and a bottom of each of the multiple second water gathering zones 14 has a first inlet 141 defined thereon and communicating with the accommodation tube 10. The accommodation tube 10 includes multiple first guide orifices 15 arranged on a first peripheral side thereof so as to define a first shoulder 151, and the accommodation tube 10 includes multiple second guide orifices 16 arranged on a second peripheral side thereof so as to define a second shoulder 161, wherein each of the multiple first guide orifices 15 is located below two sides of each first water gathering zone 13 and communicates with the accommodation tube 10, and each of the multiple second guide orifices 16 is located below two sides of each second water gathering zone 14 and communicates with the accommodation tube 10, hence a control bar 20 is rotatably connected and horizontally moves in each first guide orifice 15 and each second guide orifice 16. Referring to FIG. 4, the control bar 20 includes two fitting sections 21 respectively arranged on two ends thereof and fitting with two push elements 22, wherein each of the two push elements 22 has a column 221 extending therein so as to fit with each fitting section 21 of the control bar 20, and a notch 222 is defined by an inner wall of each push element 22 and an outer wall of the column 221 so as to connect with each first guide orifice 15 or each second guide orifice 16, hence the column 221 of each push element 22 is located between each fitting section 21 and each first guide orifice 15 or between each fitting section 21 and each second guide orifice 16, and the column 221 of each push element 22 separates a limitation space A from the first shoulder 151 or the second shoulder 161 so as to control the control bar 20 to move horizontally and to be limited by each push element 22. The control bar 20 includes a plane 23 defined on a top thereof, an inflow chamber 24 formed in a hole shape and passing through a middle section of the control bar 20, a receiving portion 25 formed on a side of the inflow chamber 24 so as to house a stop element 26 made of a flexible rubber, such that the stop element 26 abuts against a bottom of each first water gathering zone 13 and of each second water gathering zone 14. The receiving portion 25 includes a square coupling zone 251 formed on a top thereof, a connection section 252 defined on a middle section of the receiving portion 25 and its diameter is less than the square coupling zone 251, and a through orifice 253 defined on a bottom of the receiving portion 25 and its diameter is more than the connection section 252. The stop element 26 is square and is accommodated in the square coupling zone 251, and the stop element 26 has a foot 261 extending outwardly from a bottom thereof so as to fit with the connection section 252. The control bar 20 further includes two slots 27 respectively defined on two sides thereof so as to accommodate two seal rings 28 which individually abut against each first guide orifice 15 and each second guide orifice 16, thus avoiding water leakage out of the accommodation tube 10. The accommodation tube 10 further includes an elongated lid 30 connected on the top of the accommodation tube 10 and made of plastic material so as to cover and separate the multiple water outflow zones 11, the multiple first water gathering zones 13, and the multiple second water gathering zones 14. The elongated lid 30 includes multiple nozzle elements 31 formed on a top thereof, any two adjacent of the multiple nozzle elements 31 are obliquely and separately arranged on two sides of the top of the elongated lid 30, each first water gathering zone 13 communicates with one or more than one nozzle element 31, and each second water gathering zone 14 communicates with one or more than one nozzle element 31. A fixing plate 40 is mounted on the elongated lid 30, and a cap 50 covers the accommodation tube 10, wherein the fixing plate 40 includes multiple first apertures 41 formed thereon and corresponding to the multiple nozzle elements 31, and the cap 50 includes multiple second apertures 51 formed thereon and corresponding to the multiple nozzle elements 31, such that the multiple nozzle elements 31 respectively extend out of the fixing plate 40 and the cap 50 via the multiple first apertures 41 and the multiple second apertures 51. The fixing plate 40 is connected on the accommodation tube 10 in an ultrasound adhesion manner, and a tip of each of the multiple nozzle elements 31 is higher than a tilted peripheral side of an upper end of each nozzle element 31, two edges of the accommodation tube 10 are individually a water supply segment and a closed segment, wherein the water supply segment of the accommodation tube 10 is driven by a control assembly (not shown) so as to actuate the accommodation tube 10 to rotatably spray water at any angles.

Figure 5:
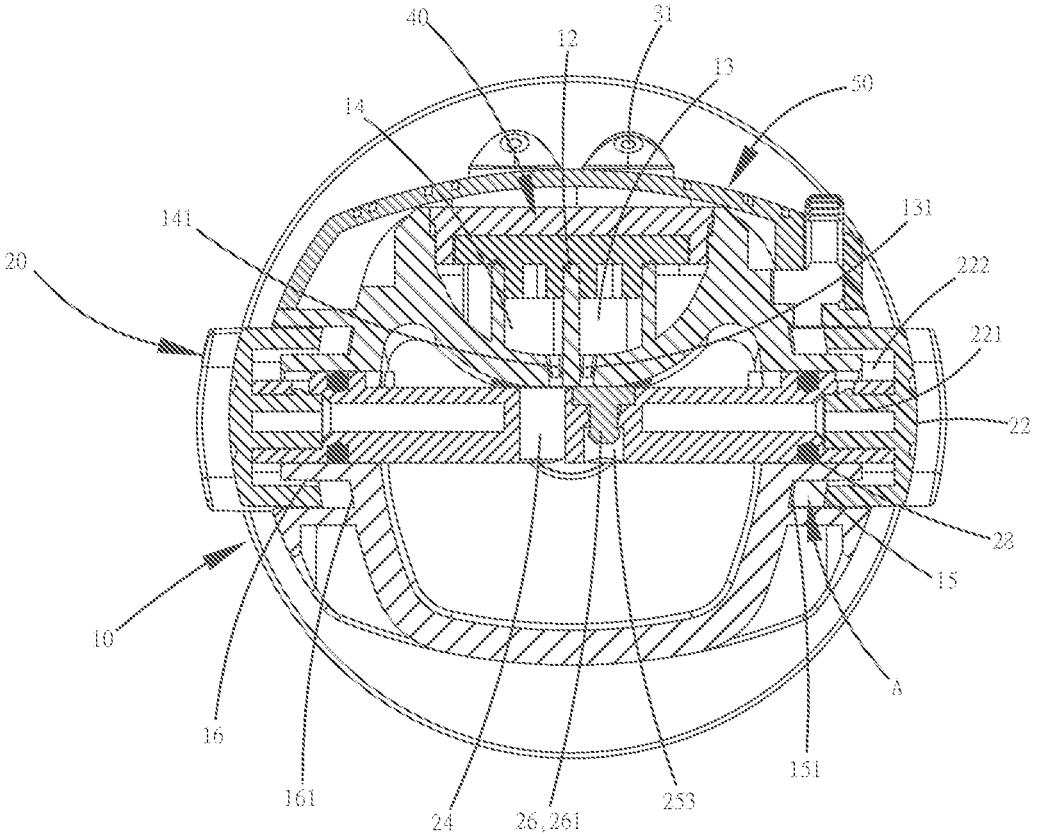
FIG. 5 is a cross sectional view showing the operation of the sprinkler structure according to the first embodiment of the present invention.
Figure 6:
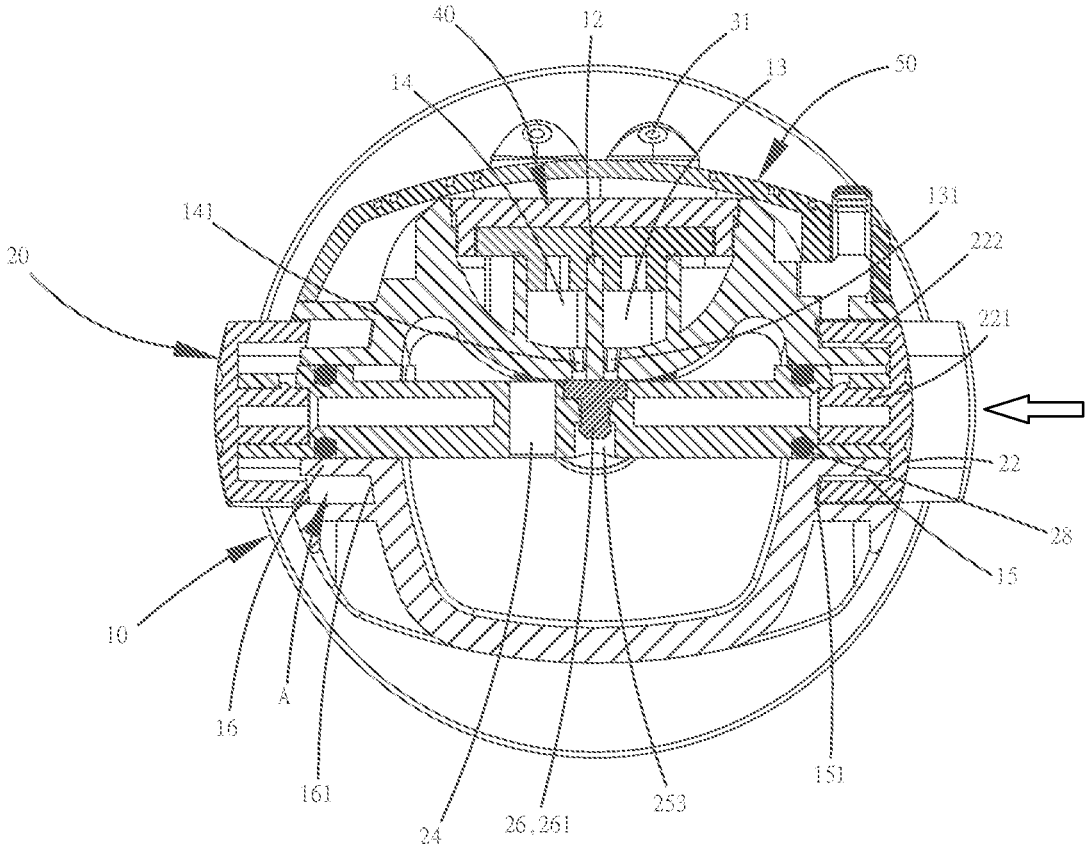
FIG. 6 is another cross sectional view showing the operation of the sprinkler structure according to the first embodiment of the present invention.

As shown in FIGS. 3 and 4, when the control bar 20 is pushed to each push element 22 on the first peripheral side of the accommodation tube 10 along each first guide orifice 15 and each second guide orifice 16 of the accommodation tube 10 so as to be stopped by the second shoulder 161, the inflow chamber 24 simultaneously communicates with the first inlet 131 of each first water gathering zone 13 and the second inlet 141 of each second water gathering zone 14 so that the water sprays out of each nozzle element 31 from the accommodation tube 10 via each of the multiple water outflow zones 11 and via the inflow chamber 24 of the control bar 20, the first inlet 131 of each first water gathering zone 13, and the second inlet 141 of each second water gathering zone 14, thus spraying the water out of each nozzle element 31 at a large area. As illustrated in FIG. 5, when each push element 22 of the control bar 20 is pushed to the second peripheral side of the accommodation tube 10 along the limitation space A until the stop element 26 stops the first inlet 131 of each first water gathering zone 13, the water does not flow into the first inlet 131, and the inflow chamber 24 merely communicates with the second inlet 141 of each second water gathering zone 14 so that the water gathers in each second water gathering zone 14 via the inflow chamber 24 and sprays out of each nozzle element 31 above each second water gathering zone 14. In the meantime, the water is isolated by each grooved partition 12 so that the water does not flow into each first water gathering zone 13 and each nozzle element 31 above each first water gathering zone 13 is closed, thus spraying the water out of each nozzle element 31 at a small area. Furthermore, the water pushes the stop element 26 from the accommodation tube 10 via the through orifice 253 of the receiving portion 25 so that the stop element 26 is pushed by a water pressure to matingly contact with the first inlet 131 of each first water gathering zone 13, thus avoiding water leakage. With reference to FIG. 6, when each push element 22 of the control bar 20 is further pushed to be stopped by the first shoulder 151 of the multiple first guide orifices 15, the first inlet 131 of each first water gathering zone 13 and the second inlet 141 of each second water gathering zone 14 are closed by the stop element 26 so as to stop the water, hence each nozzle element 31 of the first water gathering zone 13 and of the second water gathering zone 14 is closed so as to spray the water in a smaller area. Preferably, the stop element 26 is pushed by the water pressure to matingly contact with the first inlet 131 of each first water gathering zone 13 and the second inlet 141 of each second water gathering zone 14 so as to prevent the water flowing into each first water gathering zone 13 and each second water gathering zone 14. The receiving portion 25 of the control bar 20 accommodates the stop element 26, and the inflow chamber 24 communicates with the first inlet 131 of each first water gathering zone 13 and the second inlet 141 of each second water gathering zone 14 so as to control a number of the multiple nozzle elements 31 where the water sprays out.

Figure 7:
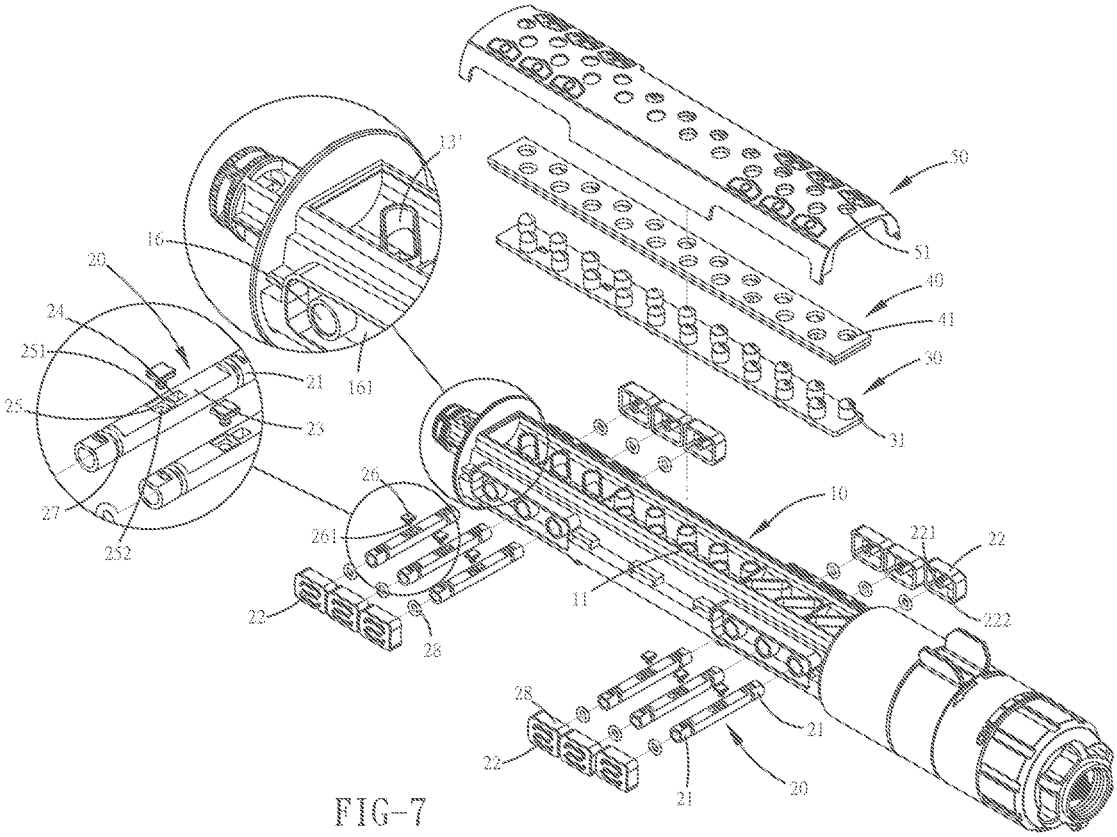
FIG. 7 is a perspective view showing exploded components of a sprinkler structure according to a second embodiment of the present invention.
Figure 8:
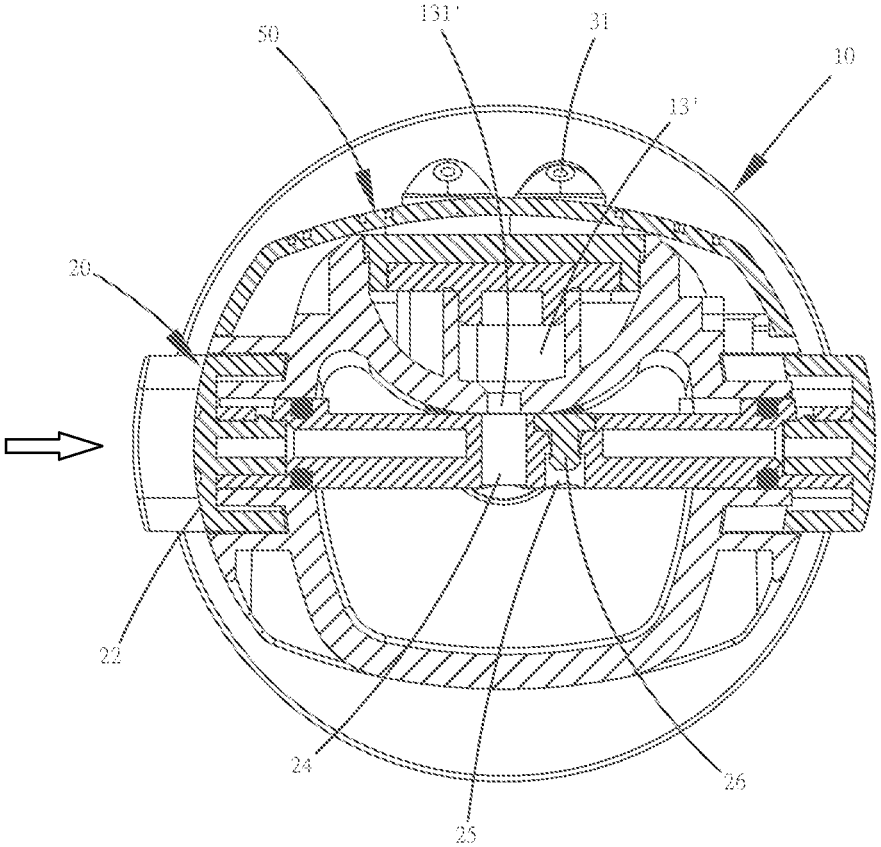
FIG. 8 is a cross sectional view showing the assembly of the sprinkler structure according to the second embodiment of the present invention.
Figure 9:
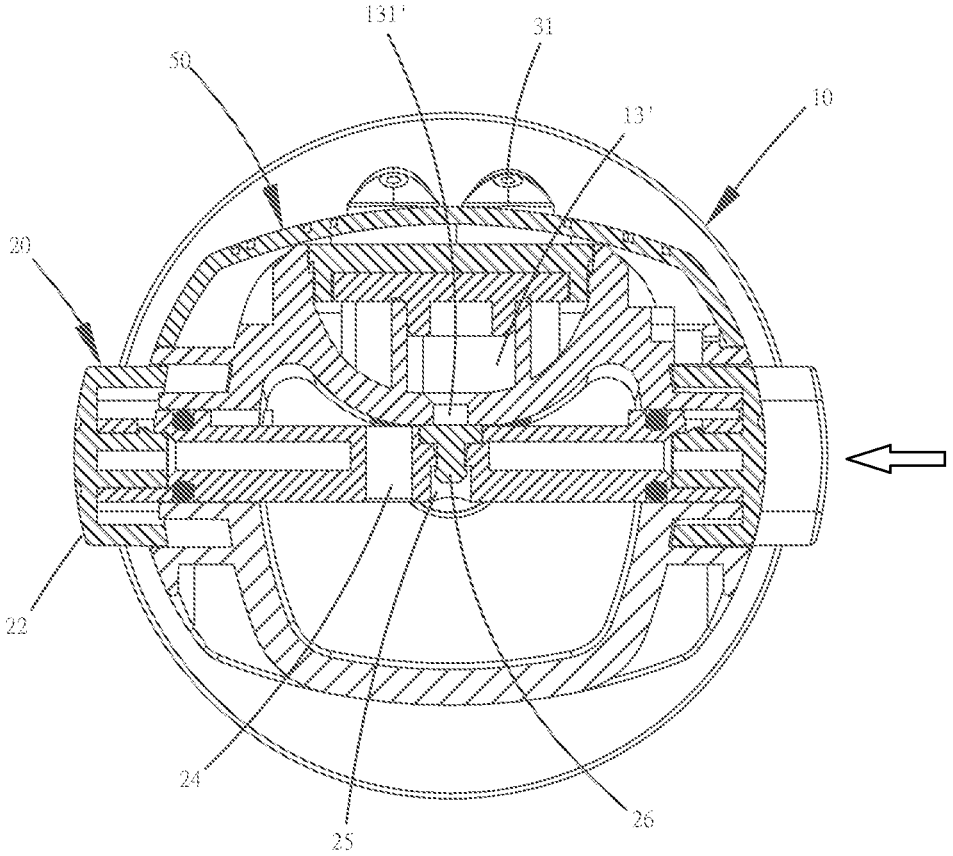
FIG. 9 is a cross sectional view showing the operation of the sprinkler structure according to the second embodiment of the present invention.

Referring to FIGS. 7 and 8, in a second embodiment, the accommodation tube 10 does not include the multiple grooved partitions 12 of the first embodiment and includes multiple water gathering zones 13', each of the multiple water gathering zones 13' has an inlet 131' defined on a bottom thereof and matching with the control bar 20, and each water gathering zone 13' communicates with two or more than two nozzle elements 31, when the control bar 20 is pushed to the second peripheral side of the accommodation tube 10 until the inflow chamber 24 communicates with the inlet 131' of each water gathering zone 13', the water sprays out of each nozzle element 31 of each water outflow zone 11 from the water supply segment 101 of the accommodation tube 10, and the water flows into each water gathering zone 13' so as to spray out of each nozzle element 31' of each water gathering zone 13' from the inlet 131' via the inflow chamber 24 of the control bar 20, hence the water sprays out of each nozzle element 31' in a large area. As shown in FIG. 9, when the each push element 22 of the control bar 20 is pushed to the second peripheral side of the accommodation tube 10, each water gathering zone 13' is closed by the stop element 26 so that when the water is stopped flowing into each water gathering zone 13', each nozzle element 31 of each water gathering zone 13' is closed, thus spraying the water in a small area.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

Having described the invention in detail, it will be apparent that modifications and variations are possible without departing from the scope of the invention defined in the appended claims.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A sprinkler structure comprising:

an accommodation tube, multiple water outflow zones separately defined on a middle section of a top of the accommodation tube, multiple grooved partitions arranged on two ends of the top of the accommodation tube respectively, multiple first water gathering zones and multiple second water gathering zones which are defined inside the multiple grooved partitions individually, wherein each of the multiple first water gathering zones has a first inlet defined on a bottom thereof and communicating with the accommodation tube, and each of the multiple second water gathering zones has a second inlet defined on a bottom thereof and communicating with the accommodation tube, the accommodation tube includes multiple first guide orifices arranged on a first peripheral side thereof, and the accommodation tube includes multiple second guide orifices arranged on a second peripheral side thereof, wherein each of the multiple first guide orifices is located below two sides of each first water gathering zone and communicates with the accommodation tube, and each of the multiple second guide orifices is located below two sides of each second water gathering zone and communicates with the accommodation tube, hence one of a plurality of control bars is rotatably connected and horizontally moves in each first guide orifice and each second guide orifice; each of the control bars includes an inflow chamber defined on a top thereof and includes a receiving portion formed on a side of the inflow chamber so as to house a stop element, such that the stop element abuts against a bottom of each first water gathering zone and of each second water gathering zone, each of the control bars further includes two seal rings accommodated thereon and individually abutting against each first guide orifice and each second guide orifice, the accommodation tube further includes an elongated lid connected on the top of the accommodation tube so as to cover and separate the multiple water outflow zones, the multiple first water gathering zones, and the multiple second water gathering zones, wherein the elongated lid includes multiple nozzle elements formed on a top thereof, each first water gathering zone communicates with one or more than one nozzle element, and each second water gathering zone communicates with one or more than one nozzle element.

2. The sprinkler structure as claimed in claim 1, wherein a bottom of each first water gathering zone and of each second water gathering zone is flat, and each of the control bars includes a plane defined on a top thereof so as to match with the accommodation tube.

3. The sprinkler structure as claimed in claim 1, wherein a stop element is made of a flexible rubber.

4. The sprinkler structure as claimed in claim 1, wherein a tip of each of the multiple nozzle elements is higher than a tilted peripheral side of an upper end of each nozzle element.

5. The sprinkler structure as claimed in claim 1, wherein each of the control bars includes two fitting sections respectively arranged on two ends thereof and fitting with two push elements, each of the two push elements has a column extending therein so as to fit with each fitting section of each of the control bars, and a notch is defined by an inner wall of each push element and an outer wall of the column so as to connect with each first guide orifice or each second guide orifice.

6. The sprinkler structure as claimed in claim 1, wherein the inflow chamber of each of the control bars is formed in a hole shape.

7. The sprinkler structure as claimed in claim 1, wherein the receiving portion of each of the control bars includes a square coupling zone formed on a top thereof, a connection section defined on a middle section of the receiving portion and a diameter of the connection section being less than the square coupling zone, and a through orifice defined on a bottom of the receiving portion and a diameter of the through orifice being more than the connection section; the stop element is square and is accommodated in the square coupling zone, and the stop element has a foot extending outwardly from a bottom thereof so as to fit with the connection section.

8. The sprinkler structure as claimed in claim 1, wherein any two adjacent of the multiple nozzle elements are obliquely and separately arranged on two sides of a top of the elongated lid.

9. The sprinkler structure as claimed in claim 1, wherein any two adjacent of the multiple nozzle elements are separately arranged on two sides of a top of the elongated lid.

10. A sprinkler structure comprising: an accommodation tube including multiple water gathering zones so as to match with one of a plurality of control bars, each of the multiple water gathering zones having an inlet defined on a bottom of each water gathering zone and communicates with the matching control bar, wherein the accommodation tube includes multiple first guide orifices arranged on a first peripheral side thereof, and the accommodation tube includes multiple second guide orifices arranged on a second peripheral side thereof, wherein each of the multiple first guide orifices is located below two sides of each water gathering zone adjacent to the first peripheral side of the accommodation tube and communicates with the accommodation tube, and each of the multiple second guide orifices is located below two sides of each water gathering zone adjacent to the second peripheral side of the accommodation tube and communicates with the accommodation tube, hence one of the control bars is rotatably connected and horizontally moves in each first guide orifice and each second guide orifice; each of the control bars includes an inflow chamber defined on a top thereof and includes a receiving portion formed on a side of the inflow chamber so as to house a stop element, such that the stop element abuts against a bottom of each water gathering zone, each of the control bars further includes two seal rings accommodated thereon and individually abutting against each first guide orifice and each second guide orifice, the accommodation tube further includes an elongated lid connected on the top of the accommodation tube so as to cover and separate the multiple water gathering zones, wherein each water gathering zone communicates with two or more than two nozzle elements, hence the inflow chamber and the stop element are pushed by the corresponding control bar to control water to flow or not flow into the water gathering zone, thus controlling a number of the multiple nozzle elements where water sprays out.

11. The sprinkler structure as claimed in claim 10, wherein a bottom of each water gathering zone is flat, and the control bar includes a plane defined on a top thereof so as to match with the accommodation tube.

12. The sprinkler structure as claimed in claim 10, wherein a stop element is made of a flexible rubber.

13. The sprinkler structure as claimed in claim 10, wherein a tip of each of the multiple nozzle elements is higher than a tilted peripheral side of an upper end of each nozzle element.

14. The sprinkler structure as claimed in claim 10, wherein each of the control bars includes two fitting sections respectively arranged on two ends thereof and fitting with two push elements, each of the two push elements has a column extending therein so as to fit with each fitting section of the corresponding control bar, and a notch is defined by an inner wall of each push element and an outer wall of the column so as to connect with each first guide orifice or each second guide orifice.

15. The sprinkler structure as claimed in claim 10, wherein the inflow chamber of each of the control bars is formed in a hole shape.

16. The sprinkler structure as claimed in claim 10, wherein the receiving portion of each of the control bars includes a square coupling zone formed on a top thereof, a connection section defined on a middle section of the receiving portion and a diameter of the connection section being less than the square coupling zone, and a through orifice defined on a bottom of the receiving portion and a diameter of the through orifice being more than the connection section; the stop element is square and is accommodated in the square coupling zone, and the stop element has a foot extending outwardly from a bottom thereof so as to fit with the connection section.

17. The sprinkler structure as claimed in claim 10, wherein any two adjacent of the multiple nozzle elements are obliquely and separately arranged on two sides of a top of the elongated lid.

18. The sprinkler structure as claimed in claim 10, wherein any two adjacent of the multiple nozzle elements are separately arranged on two sides of a top of the elongated lid.

* * * * *